US009550357B2

(12) United States Patent
Hisaoka et al.

(10) Patent No.: US 9,550,357 B2
(45) Date of Patent: Jan. 24, 2017

(54) IMAGE PROCESSOR OF PRINTING APPARATUS AND IMAGE PROCESSING METHOD THEREOF

(71) Applicants: SCREEN Holdings Co., Ltd., Kyoto (JP); Ricoh Company, Ltd., Tokyo (JP)

(72) Inventors: Katsuyuki Hisaoka, Kyoto (JP); Kazuki Fukui, Kyoto (JP); Kunio Muraji, Kyoto (JP)

(73) Assignees: SCREEN Holdings Co., Ltd. (JP); RICOH COMPANY, LTD. (JP)

( * ) Notice: Subject to any disclaimer, the term of this patent is extended or adjusted under 35 U.S.C. 154(b) by 0 days.

(21) Appl. No.: 14/844,534

(22) Filed: Sep. 3, 2015

(65) Prior Publication Data

US 2016/0067957 A1 Mar. 10, 2016

(30) Foreign Application Priority Data

Sep. 9, 2014 (JP) ..... 2014-183480

(51) Int. Cl.
*B41J 2/045* (2006.01)
*B41J 2/21* (2006.01)

(52) U.S. Cl.
CPC ..... *B41J 2/04586* (2013.01); *B41J 2/2135* (2013.01); *B41J 2/2146* (2013.01)

(58) Field of Classification Search
CPC ..... B41J 2/2146; B41J 2/045; B41J 2/04586; B41J 2/2135
See application file for complete search history.

(56) References Cited

U.S. PATENT DOCUMENTS

2011/0285778 A1* 11/2011 Ishikawa ..... B41J 2/2139 347/15
2013/0222459 A1* 8/2013 Hisaoka ..... B41J 11/0095 347/16

FOREIGN PATENT DOCUMENTS

JP 2013-176868 9/2013

* cited by examiner

*Primary Examiner* — Sarah Al Hashimi
(74) *Attorney, Agent, or Firm* — Ostrolenk Faber LLP

(57) ABSTRACT

An image processor of a printing apparatus including a first printing head having recording units spaced at a given interval orthogonal to a transportation direction of a print medium and spaced along the transportation direction of the print medium, a second printing head disposed downstream of the first printing head, a device for obtaining recording positions of first and second images printed with the first and second printing heads, a device for calculating a positional shift amount between the recording positions of the first and second images, and a positional shift interpolating image converter performing weighting, if a remainder is generated through division of the positional shift amount by the given interval, to the first or second image depending on the remainder to convert the first or second image into a positional shift interpolating image having been shifted in accordance with skew of the print medium.

20 Claims, 9 Drawing Sheets

FROM EXTERNAL COMPUTER
RECORDING POSITION OBTAINING UNIT
WEIGHTING COEFFICIENT RECORDING UNIT
POSITIONAL SHIFT INTERPOLATING IMAGE CONVERTER
POSITIONAL SHIFT AMOUNT CALCULATING UNIT
WP
1
3
5
7
9
11
13
15
17
19
19a
19b
19c
19d
20
21
23
25
27
29
31
33
35
37
39

Fig.7

L NETWORK DATA WITH LARGE SIZED INK DROPLET

| | | | | |
|---|---|---|---|---|
| | | | | |
| 130 | | 120 | | |
| | | | 115 | |
| | 120 | | | |
| | | | | 130 |

M NETWORK DATA WITH MIDDLE SIZED INK DROPLET

| | | | | |
|---|---|---|---|---|
| | | | 70 | |
| 80 | | 70 | | |
| | | | 90 | |
| | 70 | | | |
| 90 | | | | 80 |

S NETWORK DATA WITH SMALL SIZED INK DROPLET

| | | | | |
|---|---|---|---|---|
| | 25 | | 20 | 25 |
| 20 | | 20 | | |
| | | 25 | 25 | |
| | 20 | | | |
| 25 | 20 | | 20 | 20 |

ACTUAL DATA

FG2

| | | | | |
|---|---|---|---|---|
| 170 | 100 | 28 | 2 | 0 |
| 170 | 100 | 28 | 2 | 0 |
| 170 | 100 | 28 | 2 | 0 |
| 170 | 100 | 28 | 2 | 0 |
| 170 | 100 | 28 | 2 | 0 |

SUBJECTED TO SHADING PROCESS tFG2

| | | | | |
|---|---|---|---|---|
| | S | | | |
| L | | S | | |
| | | S | | |
| | M | | | |
| M | S | | | |

ACTUAL DATA

FG2

| | | | | |
|---|---|---|---|---|
| 170 | 100 | 28 | 2 | 0 |
| 170 | 100 | 28 | 2 | 0 |
| 170 | 100 | 28 | 2 | 0 |
| 170 | 100 | 28 | 2 | 0 |
| 170 | 100 | 28 | 2 | 0 |

SUBJECTED TO SHADING PROCESS hFG2

ONE-DOT SHIFT

FG2a

| | | | | |
|---|---|---|---|---|
| 170 | 170 | 100 | 28 | 2 |
| 170 | 170 | 100 | 28 | 2 |
| 170 | 170 | 100 | 28 | 2 |
| 170 | 170 | 100 | 28 | 2 |
| 170 | 170 | 100 | 28 | 2 |

SUBJECTED TO SHADING PROCESS hFG2a

HALF-DOT SHIFT tFG2

| | | | | |
|---|---|---|---|---|
| 170 | 135 | 60 | 12 | 1 |
| 170 | 135 | 60 | 12 | 1 |
| 170 | 135 | 60 | 12 | 1 |
| 170 | 135 | 60 | 12 | 1 |
| 170 | 135 | 60 | 12 | 1 |

SUBJECTED TO SHADING PROCESS htFG2

IMAGE PROCESSOR OF PRINTING APPARATUS AND IMAGE PROCESSING METHOD THEREOF

TECHNICAL FIELD

The present invention relates to an image processor of a printing apparatus that processes image data and an image processing method thereof, the image data being used for printing with the printing apparatus having at least two printing heads individually spaced away from each other in a transportation direction of a print medium.

BACKGROUND ART

Examples of such currently-used apparatus include an inkjet printing apparatus having a transport path transporting web paper, a print unit disposed along the transport path and discharging ink droplets to the web paper for image formation, and an image processor outputting print data to the print unit. See, for example, Japanese Unexamined Patent Publication No. 2013-176868A. The print unit includes three printing heads individually spaced away from each other in a transportation direction of the web paper.

The inkjet printing apparatus with such a configuration may cause the web paper to skew upon transportation of the web paper on the transport path. When printing is performed under this state, a positional shift (also referred to as a misregister) may occur in image data between an intended positional relationship and a positional relationship of ink droplets discharged from the upstream printing head and those discharged from the downstream printing head. Accordingly, the image processor performs correction by shifting the image data in a width direction of the web paper in accordance with a skew amount of the web paper, and outputs correction image data to the print unit. Then the print unit performs printing in accordance with the correction image data.

However, the example of the currently-used apparatus with such a configuration possesses the following problem.

That is, the currently-used apparatus shifts the web paper per nozzle of the print unit in accordance with the skew amount. Consequently, the correction is sometimes performed unsatisfactorily in accordance with a skew amount having a value of a non-integral multiple of a nozzle interval, which may cause insufficient suppression of the positional shift. Here, the insufficient suppression of the positional shift leads to reduction in printing quality. As a result, the suppression of the positional shift is an important problem.

SUMMARY OF INVENTION

The present invention has been made regarding the state of the art noted above, and its one object is to provide an image processor of a printing apparatus and an image processing method thereof that allow suppression of a positional shift through devising correction of the positional shift.

The present invention is constituted as stated below to achieve the above object.

One embodiment of the present invention discloses an image processor of a printing apparatus. The image processor includes a first printing head having a plurality of recording units individually spaced away at a given interval in a direction orthogonal to a transportation direction of a print medium and individually spaced away along the transportation direction of the print medium; a second printing head disposed downstream of the first printing head and having a plurality of recording units arranged individually at a given interval in the direction orthogonal to the transportation direction of the print medium; a print unit formed by at least the two printing heads, i.e., the first printing head and the second printing head, and performing printing onto the print medium; a recording position obtaining device obtaining recording positions of a first image printed with the first printing head and a second image printed with the second printing head; a positional shift amount calculating device calculating a positional shift amount between the recording positions of the first image and the second image calculated by the recording position obtaining device, the positional shift amount being caused by skew of the print medium; and a positional shift interpolating image converter performing weighting, if a remainder is generated through division of the positional shift amount by the given interval, to the first image or the second image depending on the remainder to convert the first image or the second image into a positional shift interpolating image having been shifted in accordance with the skew of the print medium.

With the embodiment of the present invention, the positional shift amount calculating device calculates the positional shift amount, caused by the skew of the print medium, between the recording positions of the first image and the second image obtained by the recording position obtaining device. If a remainder is generated through division of the positional shift amount by the given interval, the positional shift interpolating image converter performs weighting to the first image or the second image depending on the remainder to convert the first image or the second image subjected to the weighting into the positional shift interpolating image shifted in accordance with the skew of the print medium. Here, the positional shift interpolating image is generated through the weighting depending on the remainder. This allows sufficient suppression of the positional shift regardless of the skew amount, achieving reduction in printing quality.

Moreover, it is preferable that the positional shift interpolating image converter according to the embodiment of the present invention applies a weighting coefficient determined for the remainder upon the weighting to pixel values of a given number of pixels, adjacent to one another and containing one pixel of the image to be shifted, in an area where the one pixel in the image to be shifted is deviated by the remainder.

The weighting coefficient determined for the remainder is applied to the pixel values of a given number of pixels, adjacent to one another and containing one pixel of the image to be shifted, in an area where the one pixel in the image to be shifted is deviated by the remainder. This allows the weighting while the adjacent pixel values are reflected. Consequently, disturbance of the image even under interpolation can be suppressed.

Moreover, it is preferable in the embodiment of the present invention that the given number is four.

One operation to the four pixel values at one time is only required. This achieves reduced load on a converting process by the positional shift interpolating image converter.

Moreover, it is preferable that the image processor according to the embodiment of the present invention further includes a shading device performing a shading process to the positional shift interpolating image depending on a deviation amount upon outputting the positional shift interpolating image to the print unit.

The shading device performs the shading process to the positional shift interpolating image. This allows printing of the positional shift interpolating image with the recording units of the print unit.

Another embodiment of the present invention discloses an image processing method of a printing apparatus performing printing onto a print medium with a print unit, the print unit being formed by at least two printing heads, i.e., a first printing head having a plurality of recording units individually spaced away at a given interval in a direction orthogonal to a transportation direction of the print medium and individually spaced away along the transportation direction of the print medium, and a second printing head disposed downstream of the first printing head. The method includes a recording position obtaining step of obtaining recording positions of a first image printed with the first printing head and a second image printed with the second printing head; a positional shift amount calculating step of calculating a positional shift amount between the recording positions of the first image and the second image calculated in the recording position obtaining step, the positional shift amount being caused by skew of the print medium; and a positional shift interpolating image converter step of performing weighting, if a remainder is generated through division of the positional shift amount by the given interval, to the first image or the second image depending on the remainder to convert the first image or the second image into a positional shift interpolating image having been shifted in accordance with the skew of the print medium.

In the positional shift amount calculating step according to the embodiment of the present invention, the positional shift amount is calculated between the recording positions of the first image and the second image obtained in the recording position obtaining step, the positional shift amount being caused by skew of the print medium. Moreover, in the positional shift interpolating image converter step, weighting is performed, if a remainder is generated through division of the positional shift amount by the given interval, to the first image or the second image depending on the remainder to convert the first image or the second image into the positional shift interpolating image having been shifted in accordance with the skew of the print medium. Here, weighting is performed depending on the remainder to generate the positional shift interpolating image. This achieves sufficient suppression of the positional shift regardless of the skew amount, leading to reduction in printing quality.

BRIEF DESCRIPTION OF DRAWINGS

For the purpose of illustrating the invention, there are shown in the drawings several forms which are presently preferred, it being understood, however, that the invention is not limited to the precise arrangement and instrumentalities shown.

FIG. 7 is an explanatory view illustrating a shading process to the actual data image.

DESCRIPTION OF EMBODIMENTS

The following describes one embodiment of the present invention with reference to drawings.

Figure 1:
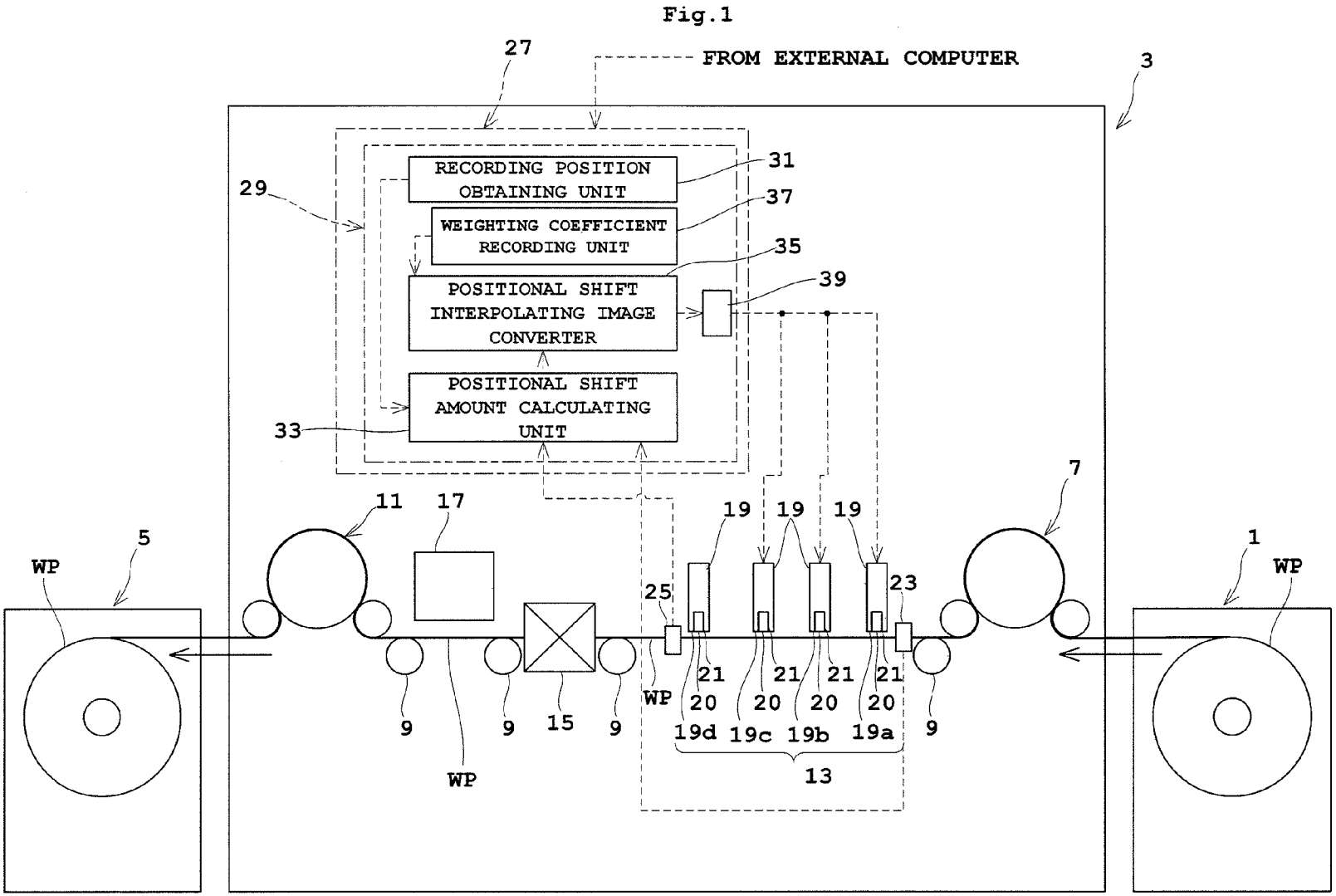
FIG. 1 is a schematic view illustrating an entire inkjet printing system according to one embodiment of the present invention.
Figure 2:
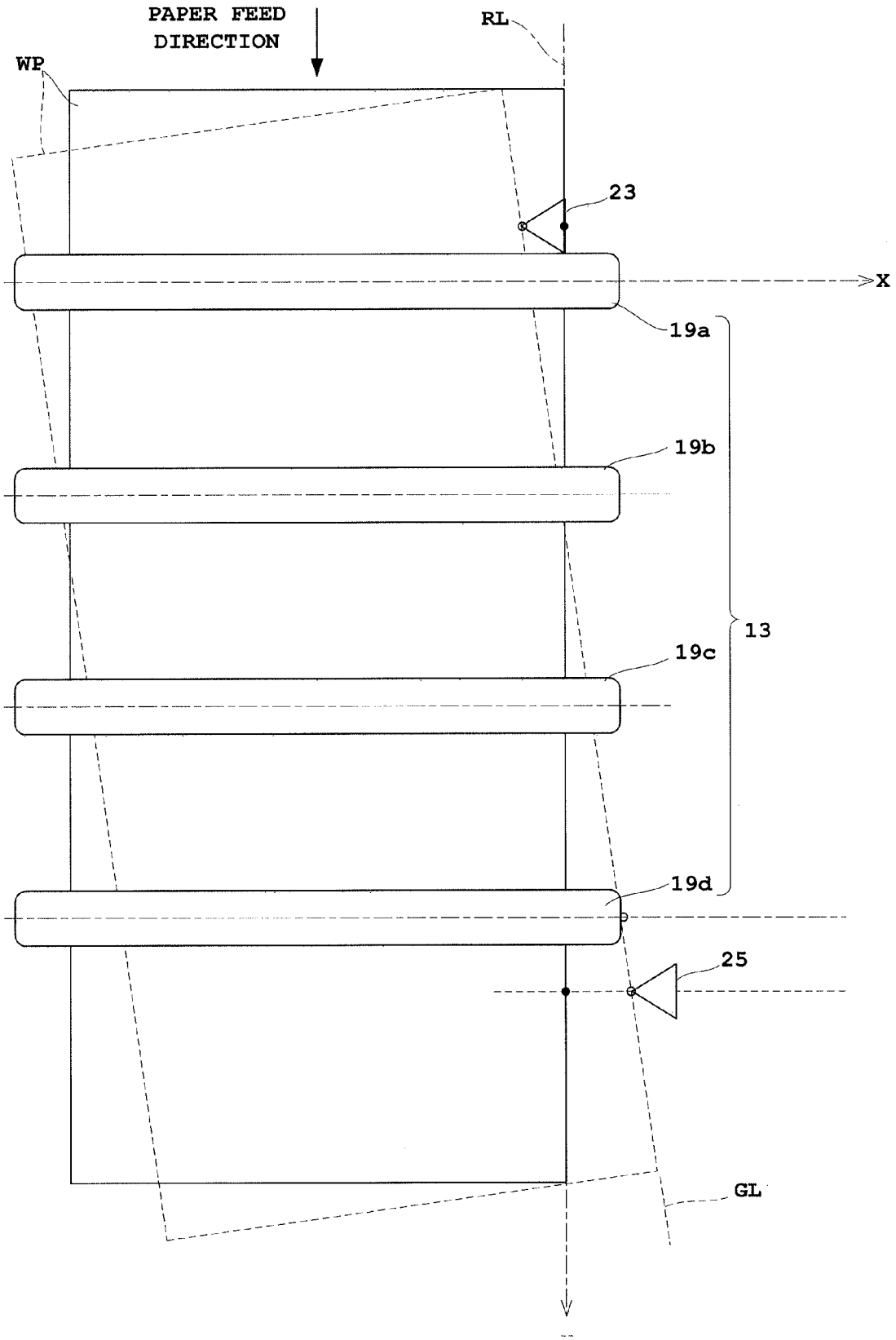
FIG. 2 is a schematic plan view of a positional relationship between printing heads and sensors.

FIG. 1 is a schematic view illustrating an entire inkjet printing system according to the embodiment of the present invention. FIG. 2 is a schematic plan view of a positional relationship between printing heads and sensors.

An inkjet printing system according to the embodiment includes a paper feeder 1, an inkjet printing apparatus 3, and a take-up roller 5.

The paper feeder 1 holds web paper WP in a roll form to be rotatable about a horizontal axis, and unwinds the web paper WP to feed it to the inkjet printing apparatus 3. The take-up roller 5 winds up the web paper WP printed by the inkjet printing apparatus 3 about the horizontal axis. Regarding the side from which the web paper WP is fed as upstream and the side to which the web paper WP is taken up as downstream, the paper feeder 1 is disposed upstream of the inkjet printing apparatus 3 whereas the take-up roller 5 is disposed downstream of the inkjet printing apparatus 3.

The inkjet printing apparatus 3 includes a drive roller 7 upstream thereof for taking in the web paper WP from the paper feeder 1. The web paper WP unwound from the paper feeder 1 by the drive roller 7 is transported downstream toward the take-up roller 5 along transport rollers 9. A drive roller 11 is disposed between the most downstream transport roller 9 and the take-up roller 5. The drive roller 11 feeds the web paper WP transported on the transport roller 9 toward the take-up roller 5.

Here, the inkjet printing apparatus 3 corresponds to the "printing apparatus" in the present invention. The web paper WP corresponds to the "print medium" in the present invention.

The inkjet printing apparatus 3 includes a print unit 13, a drier 15, and an inspecting unit 17 in this order from upstream thereof between the drive rollers 7 and 11. The drier 15 dries portions printed by the print unit 13. The inspecting unit 17 inspects the printed portions for any stains or omissions.

The print unit 13 has a plurality of printing heads 19 along a transportation direction of the web paper WP. In the present embodiment, four printing heads 19 are provided. The printing heads 19 each discharge ink droplets.

In the present embodiment, the printing heads 19 are formed by a first printing head 19*a*, a second printing head 19*b*, a third printing head 19*c*, and a fourth printing head 19*d* in this order from upstream thereof. When the four printing heads 19 should be identified individually, the above alphabets with lowercase characters are each applied to the numeral 19. The printing heads 19 are individually spaced away from each other at a given interval in the transportation direction. The first printing head 19*a*, the second printing head 19*b*, the third printing head 19*c*, and the fourth printing head 19*d* each include a nozzle part 21 with a plurality of inkjet nozzles 20 each discharging ink droplets.

The printing heads 19*a* to 19*d* discharge ink droplets in at least two colors, and allows multi-color printing onto the web paper WP. For instance, the printing head 19*a* discharges ink droplets in black (K), the printing head 19*b* discharges ink droplets in cyan (C), the printing head 19*c* discharges ink droplets in magenta (M), and the printing head 19*d* discharges ink droplets in yellow (Y). The nozzle part 21 includes a plurality of inkjet nozzles 20 arranged in the transport direction of the web paper WP (in a horizontal direction on the plane of FIG. 1) and a plurality of inkjet nozzles 20 also arranged in a direction orthogonal with respect to the transport direction of the web paper WP (in the depth direction on the plane of FIG. 1). Here, the nozzles 20 are arranged individually at a given interval L seen from the transportation direction of the web paper WP. Specifically, printing is obtainable at the given interval L of 21 μm and a resolution of 1200 dpi. For instance, it is assumed that a control target of the positional shift in a printed matter is around 35 μm. Under such assumption, correction with a unit of around 5 μm, corresponding to approximately a quarter of the given interval L, allows sufficient shift control within the control target.

Here, the inkjet nozzles 20 correspond to the "plurality of recording units" in the present invention.

The printing unit 13 includes a first sensor 23 arranged upstream thereof, and a second sensor 25 downstream thereof. The first and second sensors 23 and 25 are arranged at ends of a transport path of the web paper WP in its width direction, respectively, to detect positions of side edges of the web paper WP in the width direction. The first and second sensors 23 and 25 detect skew of the side edges of the web paper WP and a degree of skew of the web paper WP relative to a "reference line". The reference line corresponds to a transport line of the web paper WP when the web paper WP is normally transported. Then the first and second sensors 23 and 25 output the resultant as electric signals.

The inkjet printing apparatus 3 includes a controller 27. The controller 27 includes a CPU and a memory, not shown. The controller 27 also includes a data processor 29. The controller 27 receives print data as data on images to be printed on the web paper WP from an external computer, and transports the web paper WP in accordance with the print data. The image processor 29 includes a recording position obtaining unit 31, a positional shift amount calculating unit 33, a positional shift interpolating image converter 35, a weighting coefficient recording unit 37, and a shading processor 39.

The recording position obtaining unit 31 obtains recording positions of images printed with the printing heads 19 in accordance with the print data that the controller 27 has received. Moreover, the positional shift amount calculating unit 33 determines the degree of skew of the web paper WP in accordance with the signals from the first and second sensors 23 and 25, and calculates the positional shift amounts of the recording positions of the images printed with the printing heads 19. If a remainder is generated through division of the positional shift amount by the given interval L, the positional shift interpolating image converter 35 performs weighting by the remainder to the each of the images to convert it into a positional shift interpolating image having been shifted in the skewed direction. The weighting recording unit 37 stores in advance weighting coefficients used upon conversion by the positional shift interpolating image converter 35. The weighting coefficients are, for example, stored in a look up table. The shading processor 39 performs a shading process to the positional shift interpolating image. Then the positional shift interpolating image subjected to the shading process is outputted to the printing heads 19 correspondingly for performing printing onto the web paper WP. The image processor 29 detects skew of the web paper WP in accordance with the output from the first and second sensors 23 and 25. When no remainder is generated through division of the positional shift amount by the given interval L, the positional shift interpolating image converter 35 performs no conversion into the positional shift interpolating image. Instead, the image is corrected in accordance with the shift amount in such a manner that inkjet nozzles 20, other than those to discharge ink droplets under no consideration of the shift amount, discharge ink droplets.

Here, the image processor 29 corresponds to the "image processor" in the present invention. The recording position obtaining unit 31 corresponds to the "recording position obtaining device" in the present invention. The positional shift amount calculating unit 33 corresponds to the "positional shift amount calculating device" in the present invention. The positional shift interpolating image converter 35 corresponds to the "positional shift interpolating image converter" in the present invention. The shading processor 39 corresponds to the "shading device" in the present invention.

Figure 3:
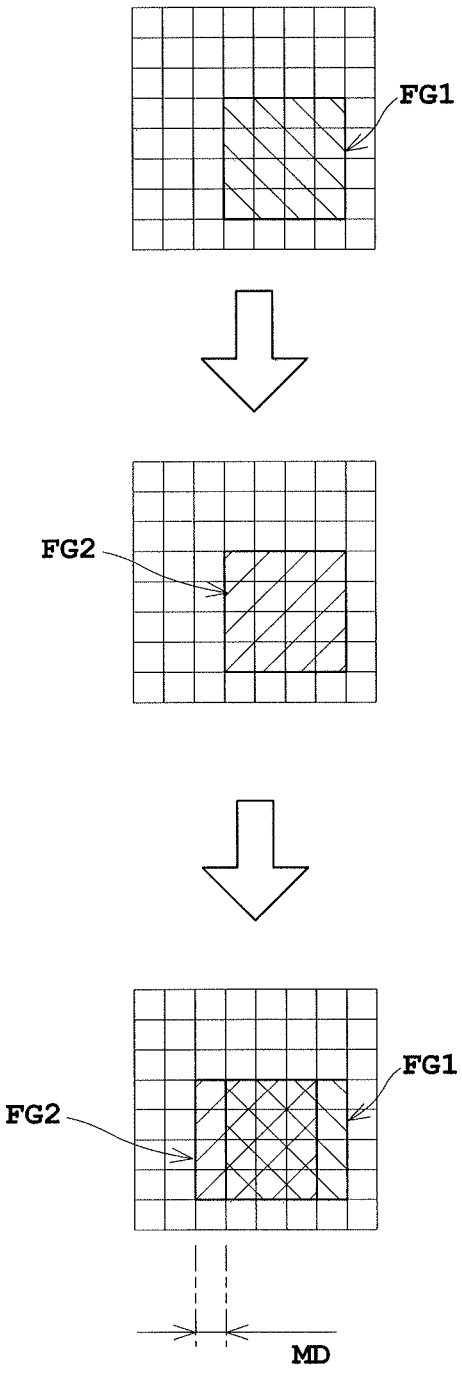
FIG. 3 is an explanatory view of a positional shift caused by skew.

Now reference is made to FIGS. 2 and 3 for describing a positional shift caused by the skew of the web paper WP. FIG. 2 is a schematic plan view of a positional relationship between printing heads and sensors. FIG. 3 is an explanatory schematic view of a positional shift caused by skew. The following description is made taking only two printing heads 19, i.e., the first printing head 19*a* and the second printing head 19*b* for facilitating understanding of the present embodiment.

When the web paper WP does not skew, the web paper WP is moved while one of the side edges of thereof conforms to a reference line RL (Y-axis) on the transport path. On the other hand, when the web paper WP skews, the web paper WP is moved while the side edge thereof conforms to a skew line GL inclined from the reference line RL toward a direction orthogonal to the transportation direction. Here, it is assumed that an X-axis is a line orthogonal to the transportation direction and along a longitudinal direction of the most upstream printing head 19*a*. For instance, the following describes a case of a shift amount MD of the printing head 19*b* relative to the printing head 19*a*. A first image FG1 is printed with the printing head 19*a* and a second image FG2 is printed with the printing head 19*b* downstream of the printing head 19*a*. When the web paper WP does not skew, both the images are superimposed on each other at the same position. With such printing data, the second image FG2 is printed while being shifted relative to the first image FG1 in the direction orthogonal to the transportation direction. At this time, the shift amount MD is a positional shift amount of the second image FG2 relative to the first image FG1 (see FIG. 3).

The positional shift amount calculating unit 33 mentioned above calculates the shift amount MD in accordance with a positional relationship between the first and second sensors 23 and 25 and the printing heads 19*a* and 19*b*. If the shift amount MD is divisible by the given interval L, i.e., if the shift amount MD is an integral multiple of the given interval L, that is, if no remainder is generated upon division of the shift amount MD by the given interval L, the positional shift interpolating image converter 35 performs no conversion of the print data into the positional shift interpolating image, but generates a correction image with the print data being shifted per inkjet nozzle 20 (per pixel) in the skewed direction in accordance with the shift amount MD. On the other hand, if the shift amount MD is not divisible by the given interval L, i.e., if the shift amount MD is not an integral multiple of the given interval L, that is, if the remainder is generated upon division of the shift amount MD by the given interval L, the positional shift interpolating image converter 35 performs weighting, to be mentioned later, depending on the remainder to convert the print data into the positional shift interpolating image shifted in the skewed direction.

Figure 4:
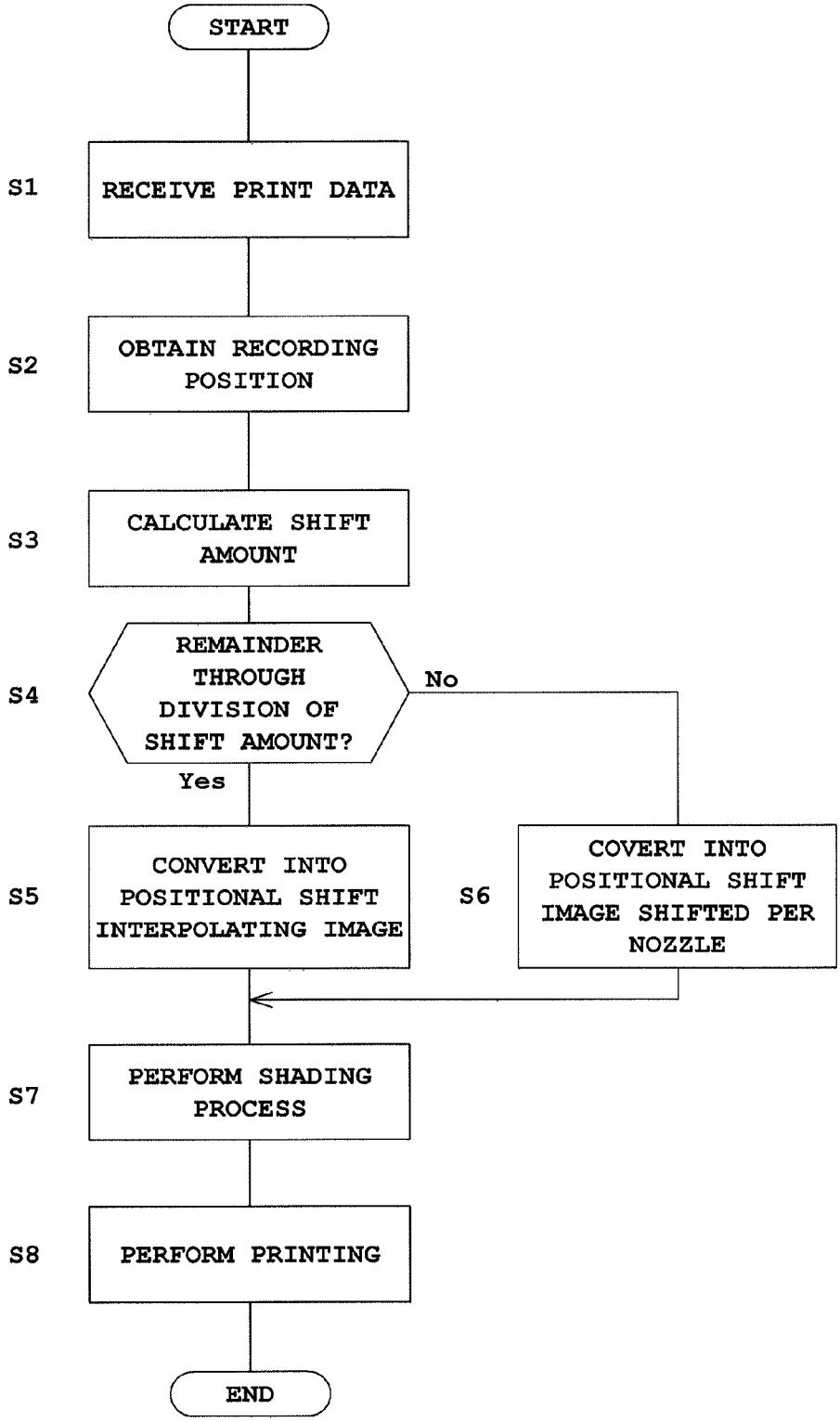
FIG. 4 is a flow chart illustrating a printing process.

The following describes a printing operation by the inkjet printing apparatus 3 with reference to FIG. 4. FIG. 4 is a flow chart of the printing operation.

Step S1

The controller 27 receives the print data from the external computer.

Step S2 (Obtaining Recording Position)

The recording position obtaining unit 31 obtains recording positions of the first and second images printed with the printing heads 19*a* and 19*b*, respectively, in accordance with the print data.

Step S3 (Calculating Positional Shift Amount)

The positional shift amount calculating unit 33 calculates a shift amount MD for the recording positions of the image data printed with the printing heads 19*a* and 19*b* in accordance with output signals from the first and second sensors 23 and 25.

Step S4

The positional shift interpolating image converter 35 causes the process to branch depending on whether or not a remainder is generated through division of the shift amount MD by the given interval L. If the remainder is generated, the process proceeds to branch to a step S5. If no remainder is generated, the process proceeds to branch to a step S6.

Step S5 (Converting into Positional Shift Interpolating Image)

Accurate correction is impossible through shift for every inkjet nozzle 20 (for every pixel). Accordingly, the positional shift interpolating image converter 35 converts the second image printed with the printing head 19*b*, for example, into a positional shift interpolating image.

Step S6

The positional shift interpolating image converter 35 shifts the second image printed with the printing head 19*b* per inkjet nozzle 20 (per pixel), thereby generating a correction image.

Step S7

The shading processor 39 performs a shading process to the first image and the second image (the positional shift interpolating image or the correction image).

Step S8

The controller 27 causes the print unit 13 to perform printing onto the first and second images each subjected to the shading process.

Figure 5:
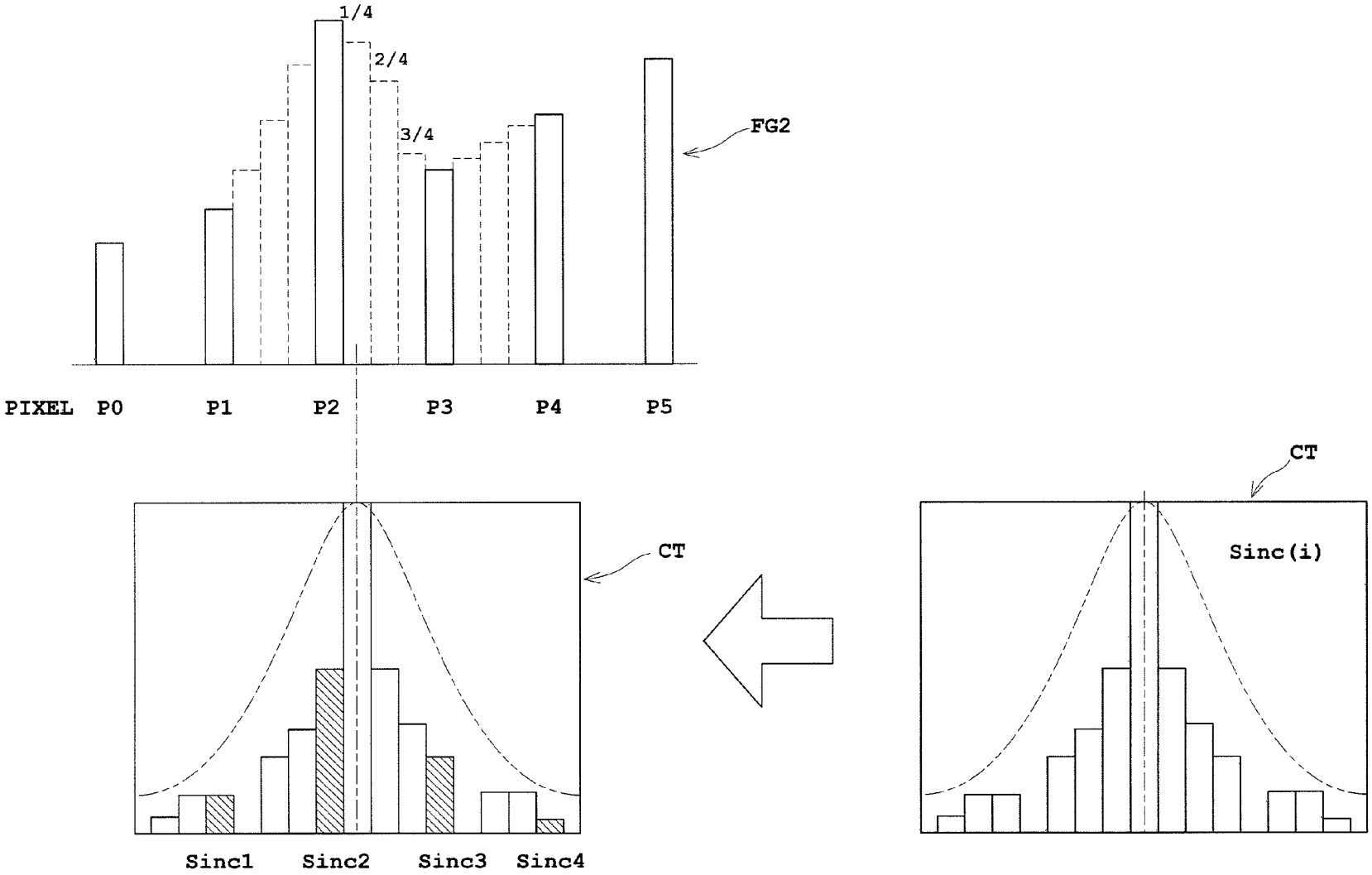
FIG. 5 is an explanatory schematic view of a weighting process.
Figure 6:
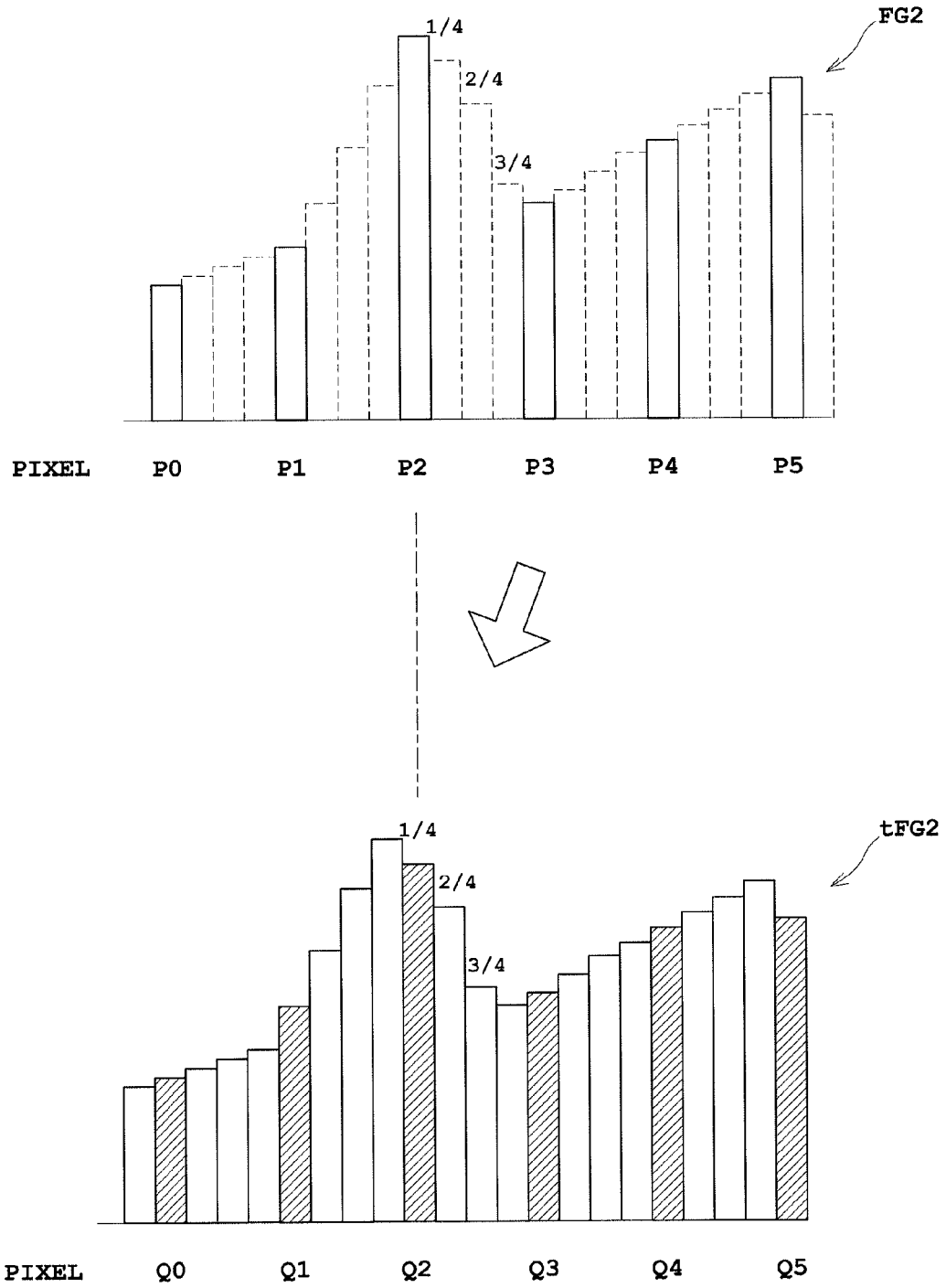
FIG. 6 is a schematic view of an actual data image and a converted positional shift interpolating image.

Now reference is made to FIGS. 5 and 6 for describing the weighting process mentioned above. FIG. 5 is an explanatory schematic view of the weighting process. FIG. 6 is a schematic view of an actual data image and the converted positional shift interpolating image.

As mentioned above, the positional shift interpolating image converter 35 converts the second image FG2 of the print data into the positional shift interpolating image when some remainder exists between the shift amount MD and the given interval L. The second image FG2 contains actual data every given interval L. A weighting coefficient CT is, for example, a three-dimensional SINC function. The SINC function is considered rectifiable, and is stored in the weighting coefficient recording unit 37 as a look up table. It is preferable that the weighting coefficient CT is determined and stored for every remainder. Here, it is assumed that the remainder is a quarter of the given interval L and the weighting coefficient CT corresponding to the remainder is stored.

The positional shift interpolating image converter 35 applies the weighting coefficient CT to four pixel values of pixels, adjacent to one another and containing one pixel of the second image FG2 to be shifted, in an area where the one pixel in the second image FG2 to be shifted is deviated by the remainder.

As in the following equation, the sum of products of pixel values P(i): P1 to P4 in the second image FG2 and the shifted SINC function so as to conform to the pixel values respectively allows interpolation of pixel values in an area of the pixel P2 and one-quarter of the given interval L as pixel values Q(i): Q1 to Q4.

$$Q(i)=\Sigma(i=-1\ to\ 2)P(i)\times SINC(i)=P1\times SINC1+P2\times SINC2+P3\times SINC3+P4\times SINC4$$

As noted above, the second image FG2 is converted into a positional shift interpolating image tFG2. Accordingly, the shift amount MD is applicable having a value of not an integral multiple of the given interval L but a value of a quarter, two quarters, or three quarters of the given interval L. However, since the inkjet nozzles 20 individually have a given interval L larger than the quarter, the positional shift interpolating image tFG2 cannot be printed with the given interval L directly. Consequently, the shading processor 39 should perform the following process.

Figure 8A:
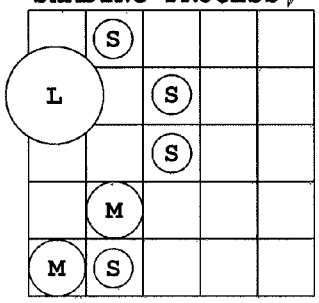
FIG. 8A is a schematic view of the actual data image and an image subjected to the shading process.
Figure 8B:
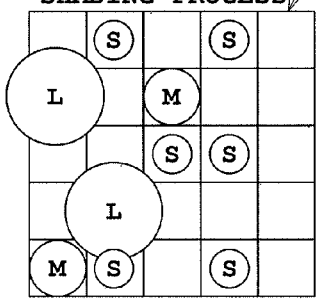
FIG. 8B is a positional shift interpolating image shifted by 1 dot from the actual data image and an image subjected to the shading process.
Figure 8C:
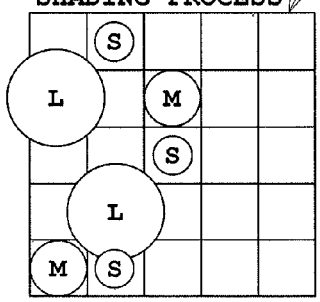
FIG. 8C is a schematic view of a positional shift interpolating image shifted by 0.5 dot from the actual data image and an image subjected to the shading process.

Now reference is made to FIGS. 7 and 8. Here, it is assumed that the shift amount MD is half the given interval L for facilitating description of the present embodiment. FIG. 7 is an explanatory view illustrating a shading process to the actual data image. FIG. 8A is a schematic view of the actual data image and an image subjected to the shading process. FIG. 8B is a positional shift interpolating image shifted by 1 dot from the actual data image. FIG. 8C is a schematic view of a positional shift interpolating image shifted by 0.5 dot from the actual data image and the image subjected to the shading process. In the present embodiment, it is assumed that the printing heads 19 discharge three types of ink droplets, i.e., large sized ink droplets, middle sized ink droplets, and small sized ink droplets.

It is assumed that FIG. 7 illustrates pixel values of network data with large sized ink droplets, network data with middle sized ink droplets, network data with small sized ink droplets, and actual data (here the second image FG2). Moreover, it is assumed that the network data with the large sized ink-droplets is processed preferentially. In this case, a pixel value of the second image FG2 larger than the numeric value of the network data with the large sized ink droplets is applied for a large sized ink droplet. Thereafter, the network data with the middle sized ink droplets and the small sized ink droplets is applied. Accordingly, a shaded second image hFG2 is generated.

FIG. 8 illustrates different types of actual data and data subjected to the shading process. FIG. 8A illustrates a second image FG2 and a second image hFG2 subjected to the shading process. FIG. 8B illustrates a second image FG2*a* shifted by 1 dot and a second image hFG2*a* subjected to the shading process. FIG. 8C illustrates a positional shift interpolating image tFG2 of a second image FG2 shifted by a half dot and a second image htFG2 subjected to the shading process.

It is revealed that the second image FG2*a* (FIG. 8B) is shifted by one dot to the right relative to the second image hFG2 (FIG. 8A) subjected to the shading process with no positional shift. It is also revealed that the second image htFG2 (FIG. 8C) subjected to the shading process and shifted by the half dot contains a visible intermediate-range shift between the second image hFG2 (FIG. 8A) subjected to the shading process with no positional shift and the second image FG2*a* (FIG. 8B) shift by one dot.

Figure 9:
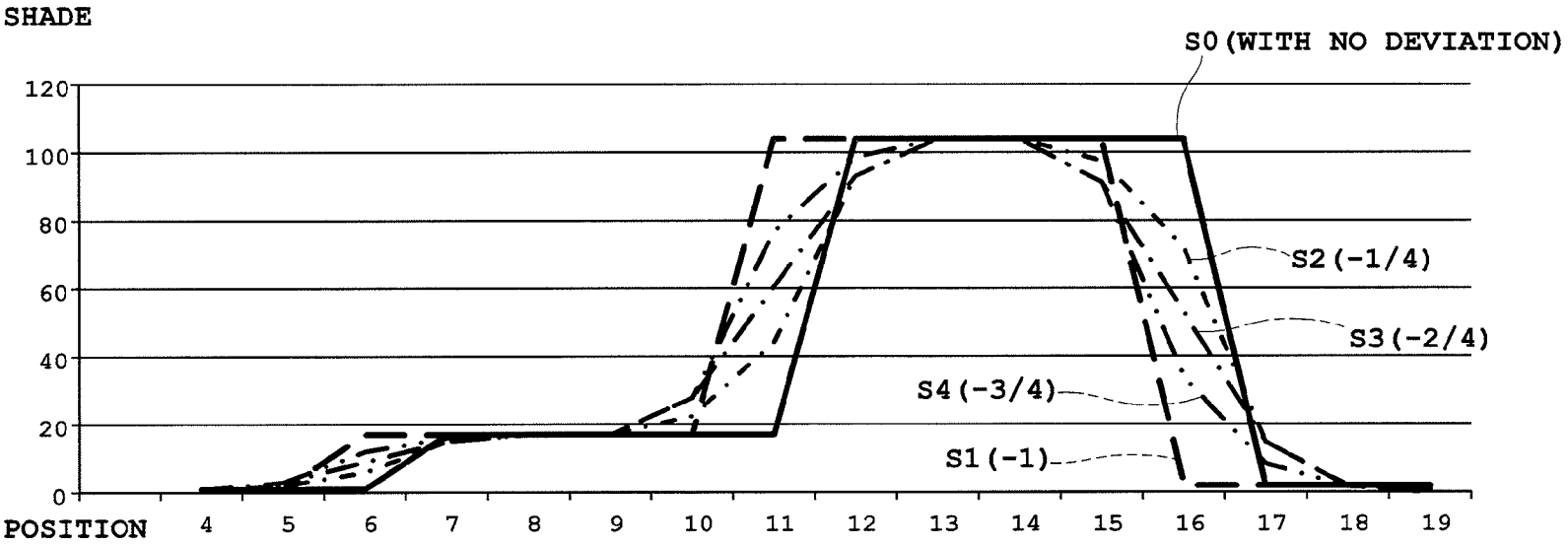
FIG. 9 is a graph illustrating a variation in shade of an image of the actual data with no deviation and that with different deviation amounts.

Now reference is made to FIG. 9. FIG. 9 is a graph illustrating a variation in shade of the actual data image with no deviation and images with different deviation amounts.

The graph reveals that when the above process is performed to deviate the original print data by an interval with a value smaller than the given interval L (i.e., one quarter, two quarters, and three quarters) to one dot, a shade gradually shifts. Accordingly, the visual barycenter is moved from that in the image with no deviation, and thus fine shade shift is made visually without any deviation per pixel.

In the present embodiment, the positional shift amount calculating unit 33 calculates the shift amount MD caused by the skew of the web paper WP with respect to the recording positions of the first image FG1 and the second image FG2 obtained by the recording position obtaining unit 31. When the shift amount MD is divided by the given interval L to generate the remainder, the positional shift interpolating image converter 35 performs weighting to the second image FG2 by the remainder and converts the second image FG2 into the positional shift interpolating image tFG2 shifted in the skewed direction of the web paper WP. Here, the positional shift interpolating image tFG2 is generated through the weighting by the remainder. This allows sufficient suppression of the positional shift regardless of the skew amount, leading to prevention of reduction in printing quality.

The present invention is not limited to the foregoing examples, but may be modified as follows.

(1) In the embodiment mentioned above, the second image FG is adopted as the positional shift interpolating image tFG2. Alternatively, the first image FG1 may be shifted in a direction opposite to the skewed direction to generate the positional shift interpolating image tFG1.

(2) In the embodiment mentioned above, the three-dimensional SINC function is used for conversion of the positional shift interpolating image. However, such an interpolate method is not limitative.

(3) In the embodiment mentioned above, an area is processed that corresponds to the four pixels adjacent to one another and containing one pixel value of the image to be shifted. However, the present invention is not limited to such an area. Alternatively, an area corresponding to five or more pixels may be processed with no problem on load.

(4) In the embodiment mentioned above, the inkjet printing apparatus 3 has been described as one example of the present invention. However, the present embodiment is applicable to various types of printing apparatus having printing heads individually spaced away from one another in the transportation direction.

(5) In the present embodiment mentioned above, the web paper WP has been described as one example of the print medium of the inkjet printing apparatus 3. However, the present invention is not limited to the web paper WP as the print medium. Alternatively, a film is applicable.

The present invention may be embodied in other specific forms without departing from the spirit or essential attributes thereof and, accordingly, reference should be made to the appended claims, rather than to the foregoing specification, as indicating the scope of the invention.

What is claimed is:

1. An image processor of a printing apparatus, processor comprising:

a first printing head having a plurality of recording units individually spaced away at a given interval in a direction orthogonal to a transportation direction of a print medium and individually spaced away along the transportation direction of the print medium;

a second printing head disposed downstream of the first printing head and having a plurality of recording units arranged individually at a given interval in the direction orthogonal to the transportation direction of the print medium;

a print unit formed by at least the two printing heads, i.e., the first printing head and the second printing head, and performing printing onto the print medium;

a recording position obtaining device obtaining recording positions of a first image printed with the first printing head and a second image printed with the second printing head;

a positional shift amount calculating device calculating a positional shift amount between the recording positions of the first image and the second image calculated by the recording position obtaining device, the positional shift amount being caused by skew of the print medium; and a positional shift interpolating image converter performing weighting, if a remainder is generated through division of the positional shift amount by the given interval, to the first image or the second image depending on the remainder to convert the first image or the second image into a positional shift interpolating image having been shifted in accordance with the skew of the print medium.

2. The image processor of the printing apparatus according to claim 1, wherein the positional shift interpolating image converter applies a weighting coefficient determined for the remainder upon the weighting to pixel values of a given number of pixels, adjacent to one another and containing one pixel of the image to be shifted, in an area where the one pixel in the image to be shifted is deviated by the remainder.

3. The image processor of the printing apparatus according to claim 2, wherein the given number is four.

4. The image processor of the printing apparatus according to claim 1, further comprising:

a shading device performing a shading process to the positional shift interpolating image depending on a deviation amount upon outputting the positional shift interpolating image to the print unit.

5. The image processor of the printing apparatus according to claim 2, further comprising:

a shading device performing a shading process to the positional shift interpolating image depending on a deviation amount upon outputting the positional shift interpolating image to the print unit.

6. The image processor of the printing apparatus according to claim 3, further comprising:

a shading device performing a shading process to the positional shift interpolating image depending on a deviation amount upon outputting the positional shift interpolating image to the print unit.

7. The image processor of the printing apparatus according to claim 1, wherein the first printing head and the second printing head perform the printing onto the print medium by discharging ink droplets.

8. The image processor of the printing apparatus according to claim 2, wherein the first printing head and the second printing head perform the printing onto the print medium by discharging ink droplets.

9. The image processor of the printing apparatus according to claim 3, wherein the first printing head and the second printing head perform the printing onto the print medium by discharging ink droplets.

10. The image processor of the printing apparatus according to claim 4, wherein the first printing head and the second printing head perform the printing onto the print medium by discharging ink droplets.

11. The image processor of the printing apparatus according to claim 5, wherein the first printing head and the second printing head perform the printing onto the print medium by discharging ink droplets.

12. The image processor of the printing apparatus according to claim 6, wherein the first printing head and the second printing head perform the printing onto the print medium by discharging ink droplets.

13. An image processing method of a printing apparatus performing printing onto a print medium with a print unit, the print unit being formed by at least two printing heads, i.e., a first printing head having a plurality of recording units individually spaced away at a given interval in a direction orthogonal to a transportation direction of the print medium and individually spaced away along the transportation direction of the print medium, and a second printing head disposed downstream of the first printing head, the method comprising:

a recording position obtaining step of obtaining recording positions of a first image printed with the first printing head and a second image printed with the second printing head;

a positional shift amount calculating step of calculating a positional shift amount between the recording positions of the first image and the second image calculated in the recording position obtaining step, the positional shift amount being caused by skew of the print medium; and a positional shift interpolating image converter step of performing weighting, if a remainder is generated through division of the positional shift amount by the given interval, to the first image or the second image depending on the remainder to convert the first image or the second image into a positional shift interpolating image having been shifted in accordance with the skew of the print medium.

14. The image processing method of the printing apparatus according to claim 13, wherein in the positional shift interpolating image converter step, a weighting coefficient determined for the remainder is applied upon the weighting to pixel values of a given number of pixels, adjacent to one another and containing one pixel of the image to be shifted, in an area where the one pixel in the image to be shifted is deviated by the remainder.

15. The image processing method of the printing apparatus according to claim 14, wherein the given number is four.

16. The image processing method of the printing apparatus according to claim 13, wherein a shading process is performed to the positional shift interpolating image depending on a deviation amount upon outputting the positional shift interpolating image to the print unit.

17. The image processing method of the printing apparatus according to claim 14, wherein a shading process is performed to the positional shift interpolating image depending on a deviation amount upon outputting the positional shift interpolating image to the print unit.

18. The image processing method of the printing apparatus according to claim 15, wherein a shading process is performed to the positional shift interpolating image depending on a deviation amount upon outputting the positional shift interpolating image to the print unit.

19. The image processing method of the printing apparatus according to claim 13, wherein the first printing head and the second printing head perform the printing onto the print medium by discharging ink droplets.

20. The image processing method of the printing apparatus according to claim 14, wherein the first printing head and the second printing head perform the printing onto the print medium by discharging ink droplets.

* * * * *